US005490560A

United States Patent [19]

Helms et al.

[11] Patent Number: 5,490,560

[45] Date of Patent: Feb. 13, 1996

[54] HEAT EXCHANGER, PARTICULARLY FOR MOTOR VEHICLES

[75] Inventors: Werner Helms, Esslingen/Zell; Karl-Heinz Rothfuss, Asperg; Walter Wolf, Oppenweiler, all of Germany

[73] Assignee: Behr GmbH & Co., Stuttgart, Germany

[21] Appl. No.: 200,382

[22] Filed: Feb. 23, 1994

[30] Foreign Application Priority Data

Feb. 26, 1993 [DE] Germany ..... 43 05 945.7

[51] Int. Cl.[6] ..... F28F 9/02

[52] U.S. Cl. ..... 165/173; 165/153; 165/175; 285/137.1

[58] Field of Search ..... 165/151, 153, 165/173, 175; 29/890.043, 890.052; 285/137.1

[56] References Cited

U.S. PATENT DOCUMENTS

| | | | |
|---|---|---|---|
| 3,216,749 | 11/1965 | Summerfield | 285/137.1 |
| 3,583,478 | 6/1971 | Fieni | 165/178 |
| 3,628,603 | 12/1971 | Fieni | 165/151 |
| 4,159,035 | 6/1979 | Chartet | 165/173 |
| 4,159,741 | 7/1979 | Nonnenmann | 165/173 |
| 4,233,726 | 11/1980 | Williams | 29/507 |
| 4,305,459 | 12/1981 | Nonnenmann | 165/173 |
| 4,467,511 | 8/1984 | Collgon | 29/890.043 |
| 5,101,561 | 4/1992 | Fuhrmann et al. | 29/890.043 |
| 5,280,964 | 1/1994 | Walker et al. | 285/137.1 X |

FOREIGN PATENT DOCUMENTS

| | | | |
|---|---|---|---|
| 0387678 | 9/1990 | European Pat. Off. . | |
| 2499234 | 8/1982 | France . | |
| 891483 | 9/1953 | Germany | 29/890.043 |
| 2519756 | 12/1975 | Germany . | |
| 1962466 | 8/1977 | Germany . | |
| 2750237 | 8/1978 | Germany . | |
| 2705632 | 8/1978 | Germany . | |
| 3026461 | 2/1982 | Germany . | |
| 3322453 | 12/1983 | Germany . | |
| 3505492 | 8/1986 | Germany . | |
| 3545554 | 7/1987 | Germany . | |
| 1590032 | 5/1981 | United Kingdom . | |
| 2122928 | 1/1984 | United Kingdom . | |

OTHER PUBLICATIONS

Abstract of JP 4–200938 dated Jul. 1992, (Patent Abstracts of Japan, M–1334, Nov. 4, 1992, vol. 16, No. 534.

*Primary Examiner*—Leonard R. Leo
*Attorney, Agent, or Firm*—Foley & Lardner

[57] ABSTRACT

A heat exchanger, particularly for motor vehicles, including a collecting tank and a metallic tube plate which has a primary side, a secondary side, and collars which are formed on it, and in which collars tubes are to be held and sealed. Neighboring collars (17, 19) are alternately directed towards the primary side (22) and towards the secondary side (23). In other words, collars disposed side by side are alternately formed in the direction of the air side and of the water side, whereby the distance between the collars can be reduced to a minimum.

19 Claims, 5 Drawing Sheets

HEAT EXCHANGER, PARTICULARLY FOR MOTOR VEHICLES

BACKGROUND OF THE INVENTION

The invention relates to a heat exchanger, particularly for motor vehicles.

In heat exchangers of the design known for example from DE-C 23 65 476 or also DE-A 24 48 332 (corresponding to U.S. Pat. Nos. 4,305,459 and 4,159,741, respectively, which are hereby incorporated by reference), the heat exchanger consists of two water or collecting tanks between which ribbed tubes are arranged, the tubes being held and sealed in so-called collars or passages in a metal tube plate. Sealing is effected by mechanically expanding the tubes relative to the collars in the tube plate. These collars are formed from the sheet metal plate, which may consist of aluminum, steel or other metals, by punching or stamping.

In another design of heat exchangers of the same generic type, according to DE-A 21 29 096 or DE-A 19 62 466 (corresponding to U.S. Pat. No. 3,628,603, which is hereby incorporated by reference) or DE-A-17 51 710 (corresponding to U.S. Pat. No. 3,583,478 which is hereby incorporated by reference), a rubber seal is arranged between the tubes and the collars in the tube plate, and the tubes are sealed relative to the collars by mechanical expansion.

While heat exchangers of the design mentioned have so-called round tubes, that is to say tubes of circular cross section, and correspondingly shaped collars, heat exchangers having so-called oval tubes, that is to say tubes having an elliptical or practically elliptical cross section, have also been made known (DE-A 35 05 492 and EP-A 0 387 678), in which case rubber seals are also arranged between the tubes and the collars of a metal plate and the tubes are mechanically expanded.

All these designs have the common feature that the collars point only in one direction, that is to say are directed either towards the air side, i.e. towards the network, or towards the water or liquid side, i.e. towards the collecting or distribution tank.

In the course of the increasing of the power of heat exchangers of this kind the need arises to arrange the tubes, whether they are round or oval tubes, more closely side by side, that is to say with the closest possible spacing. However, limits imposed by manufacture and materials are then soon reached because a minimum distance must be maintained between the walls of two collars if it is to be possible at all to form the collars from the plate.

The underlying problem addressed by the present invention is that of providing heat exchangers of the type first mentioned above which have a higher power and in particular closer tube spacing.

SUMMARY OF THE INVENTION

In accordance with the invention, this problem is solved by providing a heat exchanger having a collecting tank and a metallic tube plate which has a primary side, a secondary side, and collars which are formed on it, and in which tubes are to be held and sealed. Neighboring collars are alternately directed towards the primary side and towards the secondary side. That is to say, collars disposed side by side are alternately formed in the direction of the air side and of the water side, whereby the distance between the collars can be reduced to a minimum.

This advantage is particularly effective in the case of connections between tubes and plate which have an additional rubber seal, since the latter itself always widens the tube spacing. The collars arranged in opposite directions in accordance with the invention are also advantageous in the case of those heat exchangers which in the network region have oval tubes but in the plate region, that is to say in the collars, are converted to circular cross sections (for example DE-C 30 26 461).

According to another aspect of the invention, a method of assembling a heat exchanger comprises the steps of:

providing a tube plate having a primary side and a secondary side;

forming, from the tube plate, collars alternately directed towards the primary side and the secondary side;

inserting tubes into respective collars; and holding and sealing the tubes in the collars by mechanically expanding the tubes relative to the collars.

Further developments of the invention can be seen in that this arrangement of the collars can be applied to round and oval tubes and to seals of any kind between tubes and plate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

DETAILED DESCRIPTION OF THE PREFERRED EMBODIMENTS

Figure 1:
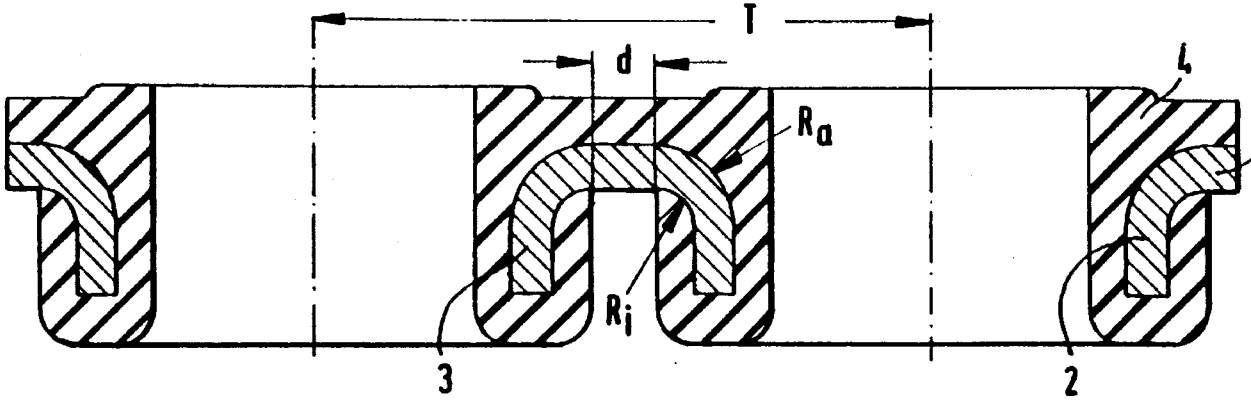
FIG. 1 PRIOR ART
FIG. 1 shows collars in a tube plate according to the prior art.

FIG. 1 shows a part of a tube plate according to the prior art for a heat exchanger, wherein the metal tube plate 1 has two collars 2 and 3 arranged in the "same direction" and formed from the plate by so-called collar forming in the same direction. In this arrangement the plate must be supported between the collars by a bottom die, which thus dictates a certain minimum distance d between the two collars 2 and 3. This distance d is also dictated by the thickness of the plate material, since this determines the radii $R_a$ and $R_i$ of the transition from the plane of the plate to the collars. The plate 1 provided with these traditional collars 2 and 3 is coated with a layer of rubber 4.

Figure 2:
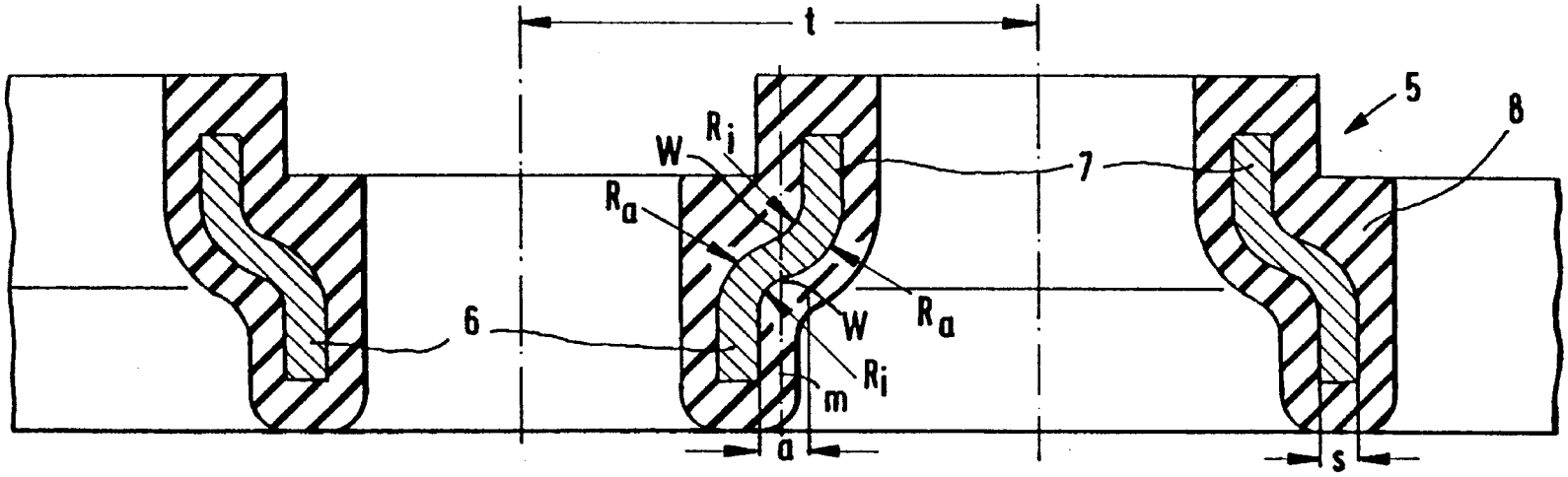
FIG. 2 shows oppositely directed collars according to the invention, which have seals attached by vulcanization.

FIG. 2 shows a part of the plate 5 according to the invention, which has two collars 6 and 7 pointing in opposite directions, the collars and the remainder of the plate region being coated with an elastomer such as rubber seal 8. The collar 7, which is to have a circular cross section, is therefore (in the drawing) directed upwards and the collar 6 is directed downwards. Both collars have at their ends facing the tube plate an external transition radius $R_a$ and an internal transition radius $R_i$, the difference between the two radii corresponding to the thickness s of the material of the collar or tube plate. Whereas in the case of the prior art in FIG. 1 each collar merges into the plane of the tube plate in a 90° arc, so that they form a distance d between them, the collars 6 and 7 according to the invention shown in FIG. 2 merge directly with their respective radii $R_a$ and $R_i$ into one another in the region of the center line m, so that the two longitudinal sections of the collars merging into one another follow an S-shaped path with a turning point W in the region of the center line m. Comparison of the two FIGS. 1 and 2, that is to say between the prior art and the invention, immediately shows that the distance d between the collars according to the invention has been eliminated, that is to say the spacing t of the collars according to the invention in FIG. 2 has become closer by at least the distance d than the corresponding spacing T in the case of the prior art. This means that the tubes inserted into these collars 6 and 7 can be arranged closer side by side and thus the power of the heat exchanger is increased. The distance a between the external peripheries of the collars 6 and 7, that is the minimum distance between two neighboring collars formed in opposite directions out of the plate, corresponds in the drawing approximately to the thickness s of the material of the plate sheet, but may also fall to zero.

Figure 3A:
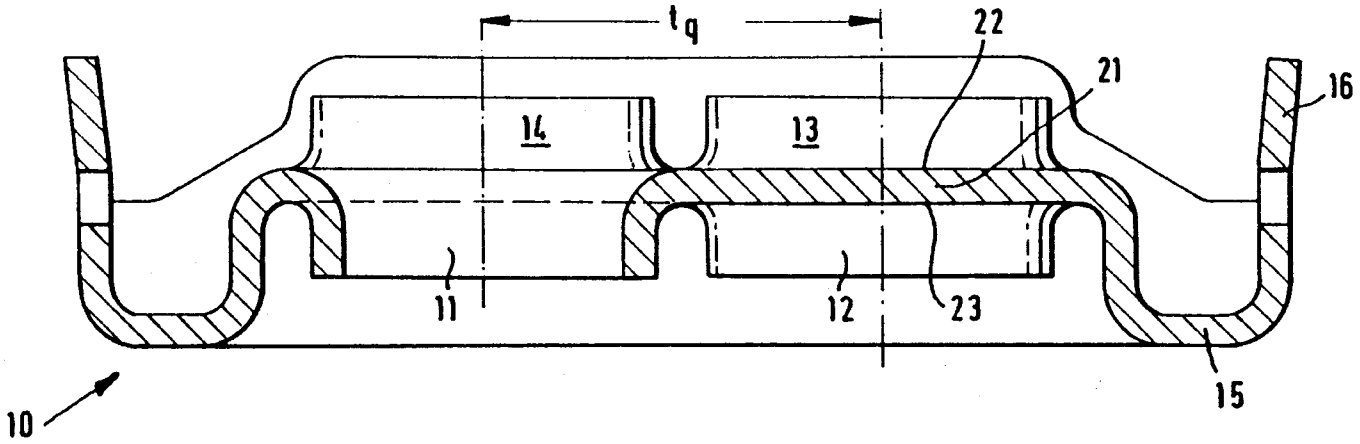
FIG. 3*a* shows in cross section a tube plate having oppositely directed collars.
Figure 3B:
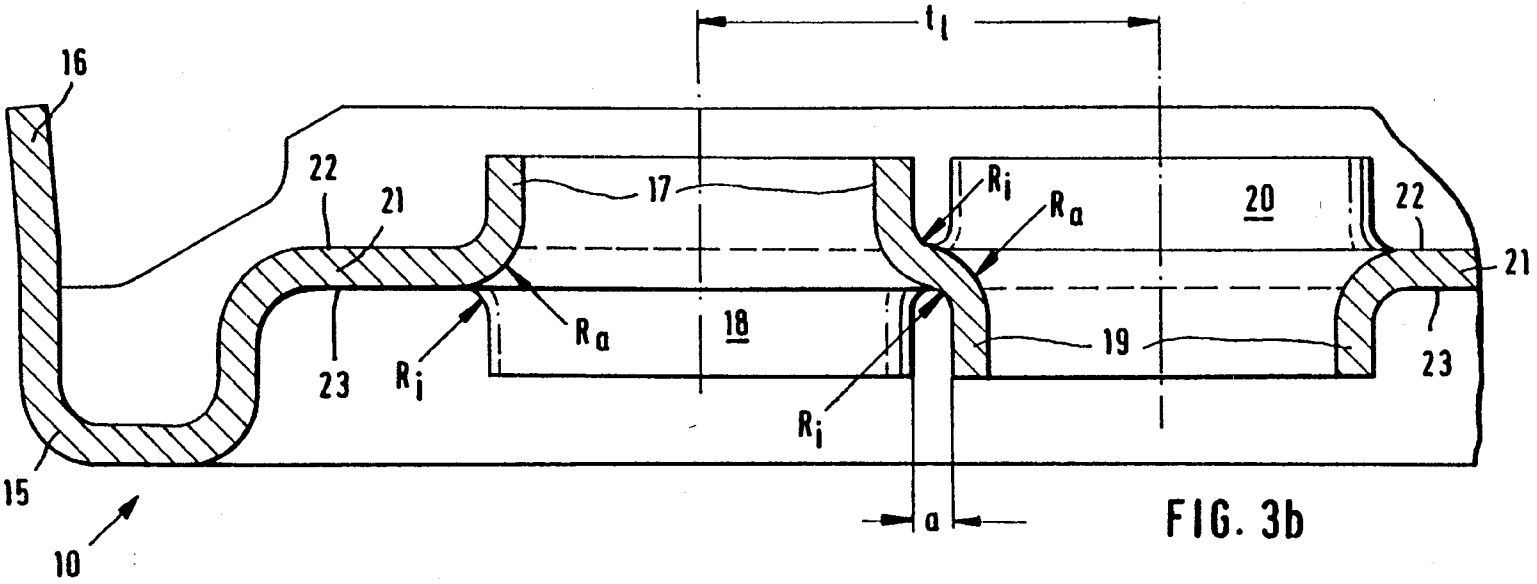
FIG. 3*b* shows in longitudinal section a tube plate having oppositely directed collars.

In FIGS. 3*a* and 3*b* a cross section and a (partial) longitudinal section through a tube plate in each case for a motor vehicle heat exchanger are shown. FIG. 3*a* shows a cross section through a tube plate 10, which has a rectangular configuration and has a peripheral groove 15 receiving a seal (not shown) and merging into a deformable edge region 16 which, as is known from the prior art, is laid around the foot of a water tank (not shown), so that between the water tank (not shown) and the tube plate a collecting or distribution tank for the heat exchange medium is formed. This plate 10 exhibits in its sectional plane an collar 11 formed from it and drawn towards the air side 23 (downwards). Another collar 14 above the collar 11 is indicated by its contour, because it lies behind the plane of the drawing and in accordance with the invention directly adjoins the collar 11. Next to these two collars 11 and 14 lie two further collars 12 and 13, which are likewise behind the plane of the drawing and therefore are not shown in section. This tube plate thus has a pattern of holes, that is to say an arrangement of collars, in which two parallel rows of offset collars are provided, the distance between the two rows of tubes (the so-called transverse spacing) being designated $t_q$.

Figure 6:
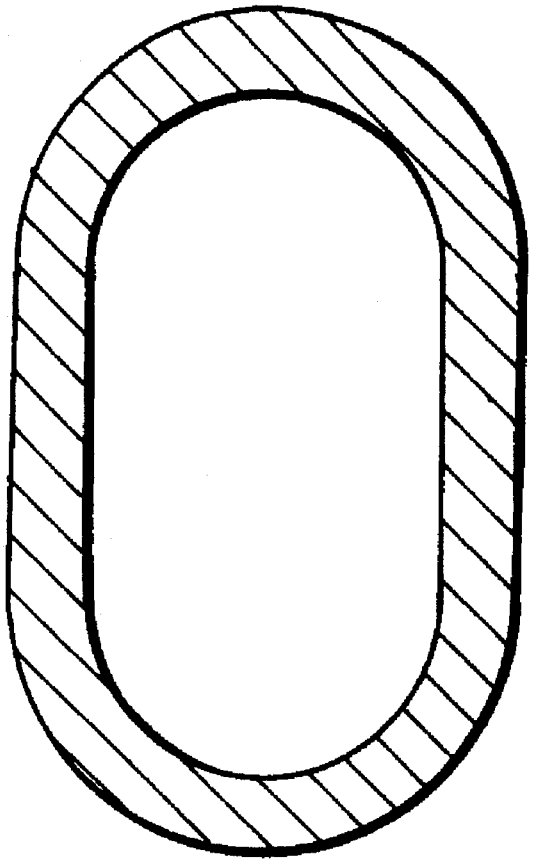
FIG. 6 is a cross section of an alternative embodiment of the collars.

An arrangement of aligned collars can be seen in FIG. 3*b*, which shows a longitudinal section through a row of collars 17 and 19 disposed side by side and drawn out of the plate 21 in opposite directions, that is to say towards the primary side 22 and towards the secondary side 23. The contours of further collars 18 and 20 behind the plane of the drawing can be seen. The spacing of two neighboring collars, that is to say the distance between two tube centers in the longitudinal direction (so-called longitudinal spacing) is designated $t_l$ and, as stated above, is shorter than in the prior art. This can also be seen from the distance a between the two collars 17/18 and 19/20, which in the embodiment shown in the drawing corresponds approximately to the wall thickness of the plate 21, but as a minimum may fall to zero. The cross section of the collars is preferably round (which means circular here), but may also be elongated as shown in FIG. 6 (which includes elliptical or oval here). Appropriately undersized tubes are inserted into the collars and are then mechanically expanded either metal-to-metal or with the interposition of a rubber seal, and thus held tightly in the tube plates.

Figure 4A:
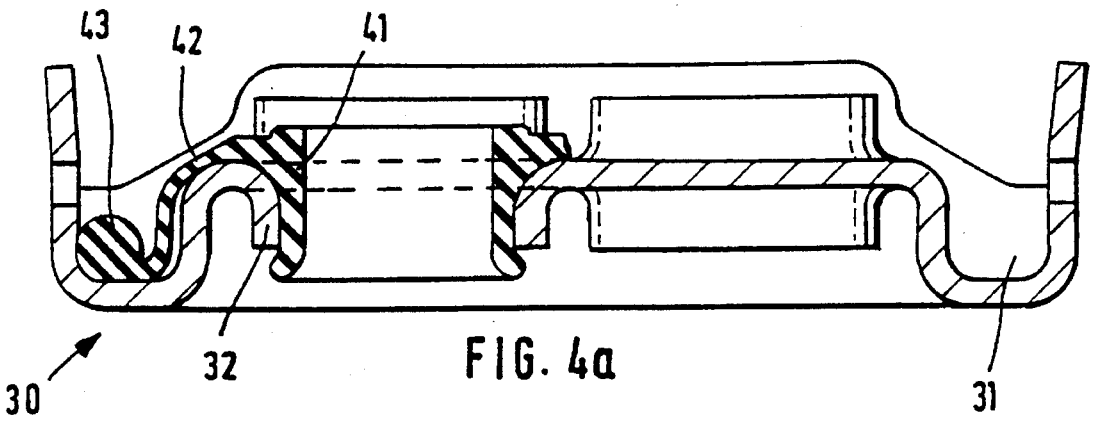
FIG. 4*a* shows a tube plate fitted with a seal.
Figure 4B:
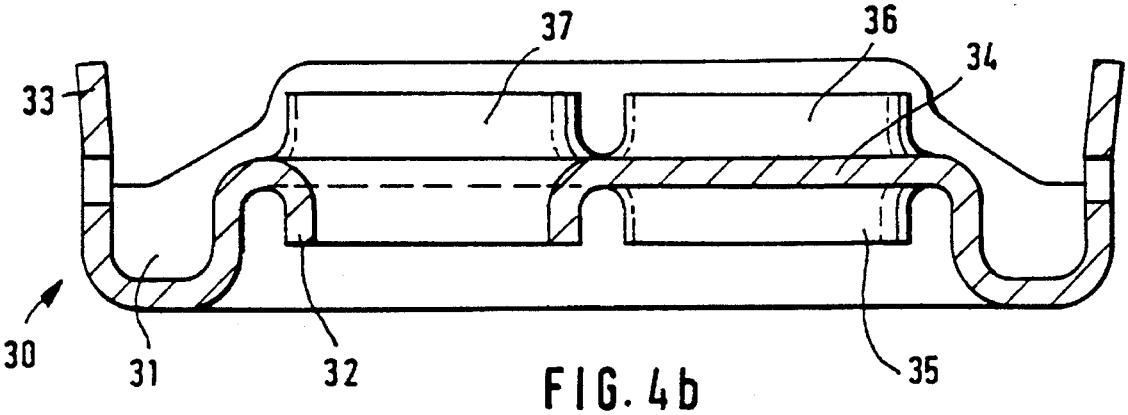
FIG. 4*b* shows the tube plate without a seal.
Figure 4C:
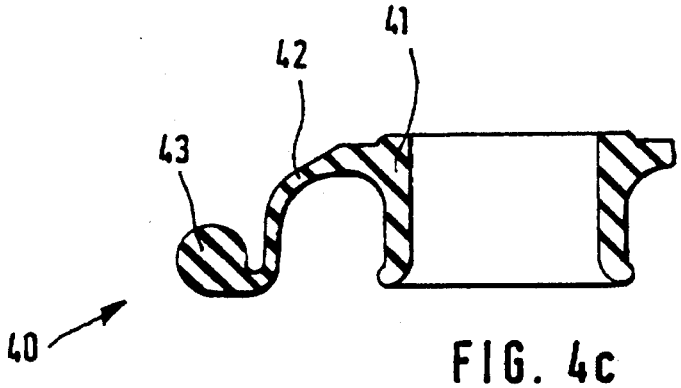
FIG. 4*c* shows the seal alone.

FIG. 4*a* shows a cross section through a tube plate provided with collars formed in opposite directions and (partly) fitted with a rubber seal; the plate 30 corresponds to the embodiment shown in FIG. 3*a* and, in accordance with FIG. 4*b*, likewise has a peripheral groove 31, which in its outer region ends in an upright rim 33 serving for fastening to a water tank (not shown). In the sectional plane of the plate 30 an collar 32 formed in the downward direction is shown, and behind the sectional plane further collars 35, 36, 37 are disposed. At the side of the collar 32 in the sectional plane the plate 34 forms a flat portion, that is to say the collars are staggered. FIG. 4*c* shows (partially) a rubber seal 40 which in its outer region has a round bead 43 connected via a lip 42 to a collar 41. This rubber collar is pressed from above, that is to say from the liquid side, into the collar 32, so that the round bead 43 comes to lie in the peripheral groove 31 in the plate 30. The entire seal 40 is formed as a continuous molding, that is to say with a peripheral round bead 43 which is connected via the likewise peripheral lip 42 to the individual collars 41, which are connected together by webs and which are disposed in accordance with the pattern of holes in the plate, although of course only for the collars directed downwards (towards the air side). The upwardly directed collars 37 and 36 are given a separate sealing plate provided with individual collars, which are pressed in from below. It is however also possible (although not shown in the drawing) for the entire seal to consist of one plate, which is fitted from one side, preferably from the water side; in this case the rubber collars, which are pressed into the collars, must have different configurations corresponding to the contours of the collars.

Tubes (not shown) are then inserted into these rubber collars and expanded mechanically.

Figure 5:
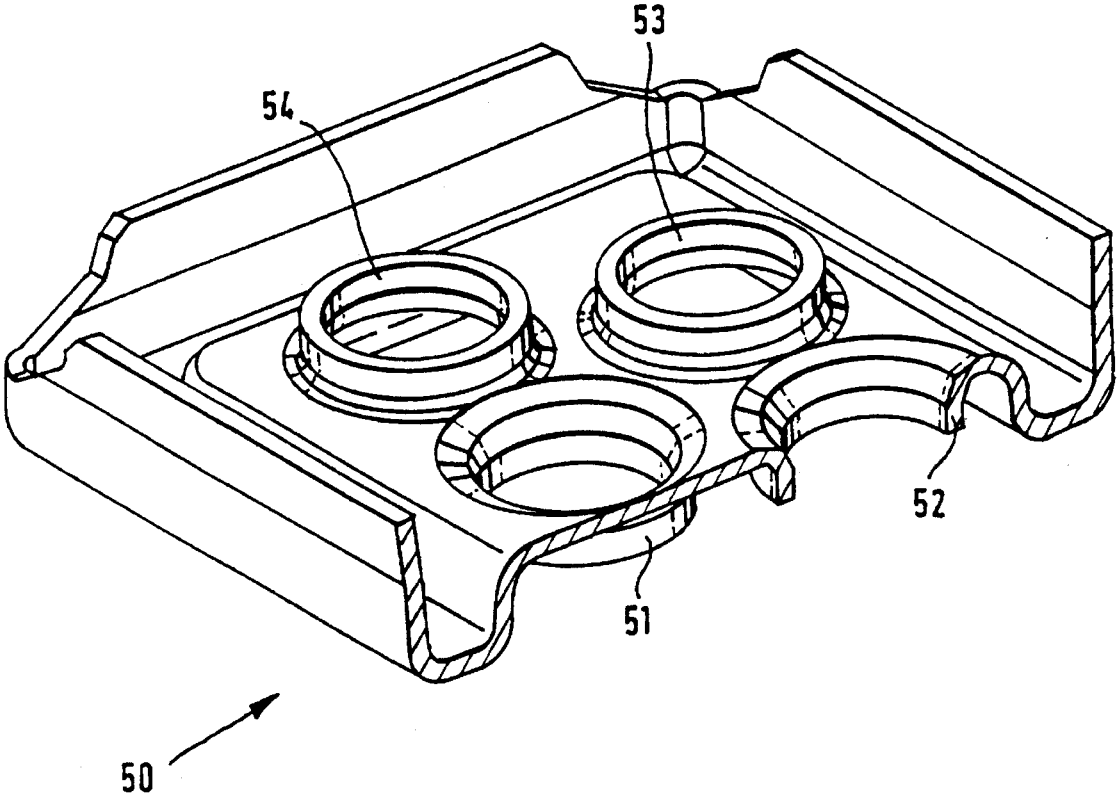
FIG. 5 is a view in perspective of the tube plate.

FIG. 5 shows a view in perspective of a part of the tube plate 50 according to the invention, wherein four collars 51, 52, 53, 54 can be seen. This tube plate 50 is therefore intended for a heat exchanger comprising two rows, that is to say, viewed in the direction of the air flow, two rows of tubes lie one behind the other in a staggered arrangement. In the first row lies the collar 54 which points towards the water side and the collar 51 pointing towards the air side. In the second row lies the collar 53 pointing towards the water side and staggered behind the two collars 51 and 54, while the other collar 52 in the second row points towards the air side. From this perspective view it can also be seen that neighboring collars 51 and 54, and also 52 and 53, of respective rows point in opposite directions and thus merge into one another in an S-shape. The tube spacing in each row, that is to say the so-called longitudinal spacing, can be reduced to a minimum, as stated previously.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A heat exchanger, particularly for motor vehicles, comprising:

a collecting tank; and a single metallic tube plate which has a primary side, a secondary side, a wall thickness and collars having a wall thickness approximately equal the wall thickness of the metallic tube plate, the collars being formed continuously from the metallic tube plate, and in which tubes are to be held and sealed, wherein neighboring collars are alternately directed towards the primary side and towards the secondary side.

2. Heat exchanger according to claim 1, wherein the collars are disposed directly side by side, and wherein radii, at a transition from the collar to a plane of the plate, of two collars directed oppositely to one another merge directly into one another in an S-shape.

3. Heat exchanger according to claim 2, wherein a minimum distance between outer walls of two neighboring, oppositely directed collars is in a range between zero and a wall thickness of the greater of the tube plate or of the collars.

4. Heat exchanger according to claim 2, wherein the collars have a round cross section.

5. Heat exchanger according to claim 2, wherein the collars have an elongated cross section.

6. Heat exchanger according to claim 2, wherein the tubes are mechanically expanded relative to the collars.

7. Heat exchanger according to claim 2, wherein rubber seals are arranged between the tubes and the collars.

8. Heat exchanger according to claim 1, wherein a minimum distance between outer walls of two neighboring, oppositely directed collars is in a range between zero and a wall thickness of the greater of the tube plate or of the collars.

9. Heat exchanger according to claim 8, wherein the collars have a round cross section.

10. Heat exchanger according to claim 8, wherein the collars have an elongated cross section.

11. Heat exchanger according to claim 1, wherein the collars have a round cross section.

12. Heat exchanger according to claim 1, wherein the collars have an elongated cross section.

13. Heat exchanger according to claim 1, wherein the tubes are mechanically expanded relative to the collars.

14. Heat exchanger according to claim 1, wherein rubber seals are arranged between the tubes and the collars.

15. Heat exchanger according to claim 14, wherein the rubber seals are in the form of sleeves and are inserted individually into respective collars.

16. Heat exchanger according to claim 14, wherein the rubber seals are in the form of continuous plates on which collars are formed and which are laid on the tube plate and inserted into the collars from both sides.

17. Heat exchanger according to claim 14, in which in a region of the collars the tube plate is covered with an elastomer.

18. Heat exchanger according to claim 14, wherein the rubber seals are in the form of a plate fitted from only one side.

19. A heat exchanger, particularly for motor vehicles, comprising:

a collecting tank; and a metallic tube plate which has a primary side, a secondary side, and collars which are formed on it, and in which tubes are to be held and sealed, wherein neighboring collars are alternately directed towards the primary side and towards the secondary side;

wherein the collars are disposed directly side by side, and wherein radii, at a transition from the collar to a plane of the plate, of two collars directed oppositely to one another merge directly into one another in an S-shape.

* * * * *